US005950398A

United States Patent [19]

Hubbard

[11] Patent Number: 5,950,398

[45] Date of Patent: Sep. 14, 1999

[54] PASS-BY INSULATING GLASS WINDOW UNIT AND METHOD FOR REPLACING SINGLE GLAZING

[76] Inventor: Bruce M. Hubbard, 2304 N. 117th St., Seattle, Wash. 98133

[21] Appl. No.: 09/178,077

[22] Filed: Oct. 22, 1998

[51] Int. Cl.[6] ..... E04C 2/54

[52] U.S. Cl. ..... 52/786.1; 52/202; 52/204.69; 52/476; 52/786.13; 52/788.1; 49/466; 49/463

[58] Field of Search ..... 52/172, 202, 203, 52/786.1, 786.13, 788.1, 214, 207, 476, 656.9, 204.69; 49/466, 463

[56] References Cited

U.S. PATENT DOCUMENTS

| | | | |
|---|---|---|---|
| 2,177,001 | 10/1939 | Owen . | |
| 3,299,591 | 1/1967 | Woelk . | |
| 3,438,112 | 4/1969 | Labruyere . | |
| 3,928,953 | 12/1975 | Mazzoni et al. | 52/172 |
| 3,971,178 | 7/1976 | Mazzoni et al. . | |
| 4,074,480 | 2/1978 | Burton . | |
| 4,185,432 | 1/1980 | Erikkson | 52/400 |
| 4,194,331 | 3/1980 | Gingle et al. . | |
| 4,357,187 | 11/1982 | Stanley et al. . | |
| 4,372,094 | 2/1983 | Boschetti | 52/741 |
| 4,494,342 | 1/1985 | Decker . | |
| 4,499,703 | 2/1985 | Rundo . | |
| 4,625,479 | 12/1986 | Giguere | 52/202 |
| 4,702,050 | 10/1987 | Giguere | 52/202 |
| 4,719,728 | 1/1988 | Ericksson et al. . | |
| 4,873,803 | 10/1989 | Rundo | 52/202 |
| 4,991,369 | 2/1991 | Lamb | 52/476 |
| 5,313,761 | 5/1994 | Leopold | 52/788 |
| 5,373,671 | 12/1994 | Roth et al. | 52/204.1 |

*Primary Examiner*—Christopher T. Kent
*Assistant Examiner*—Yvonne Horton-Richardson
*Attorney, Agent, or Firm*—Dowrey & Associates

[57] ABSTRACT

A pass-by insulating glass window unit for replacing single glazing including a sealing assembly sandwiched by glazings having dissimilar plane surface dimensions. One glazing, the exterior glazing, has the plane dimensions of the single glazing it replaces. The other, the interior glazing, and the sealing assembly have plane dimensions slightly smaller than the dimensions of the window opening. The pass-by insulating glass window unit is assembled with each of the four edges of the exterior glazing extending equidistantly outwardly from the aligned edges of the sealing assembly and the interior glazing. The thickness of the sealing assembly is predetermined to provide an enclosed insulating space of optimum insulating value. For use in double hung window sashes, the thickness is chosen to assure passage of the movable window openings, and to position the interior glazing to be in approximate alignment with the plane of the interior surface of the wood sash. The assembled pass-by insulating glass window unit is placed, interior glazing first, through the window opening or sash from the exterior side until the exterior glazing contacts the glazing rabbet.

6 Claims, 3 Drawing Sheets

FIG. 1
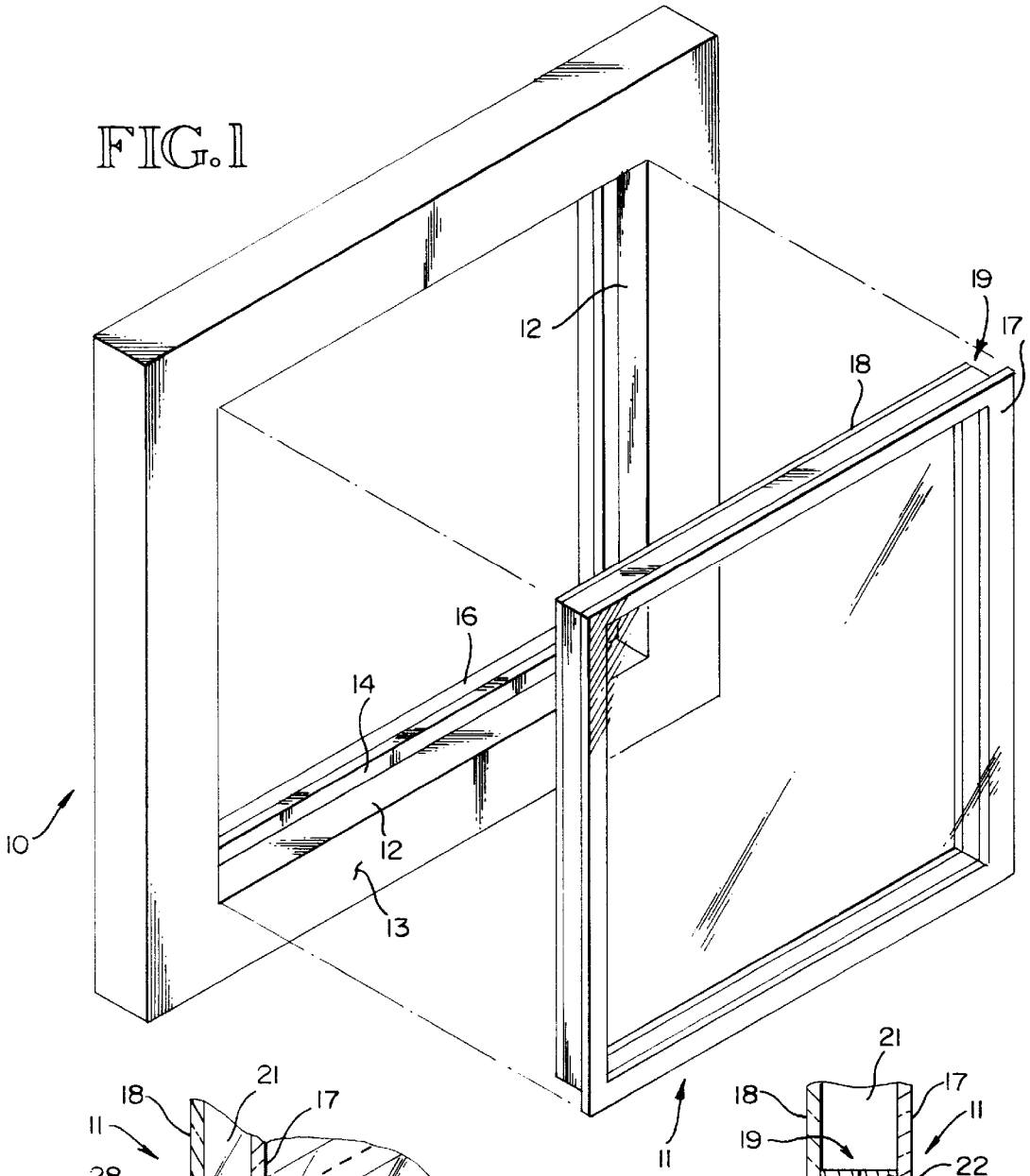
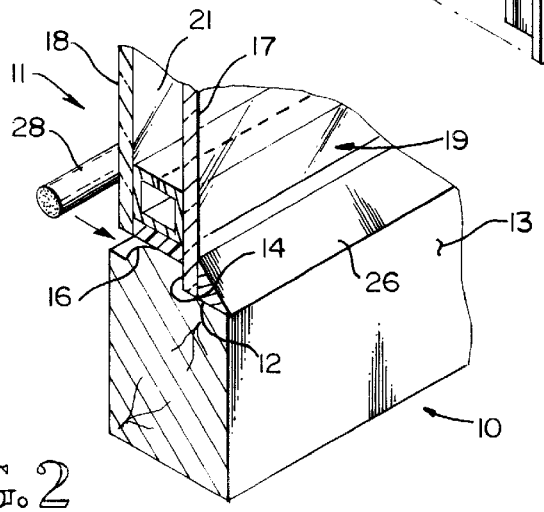
FIG. 2
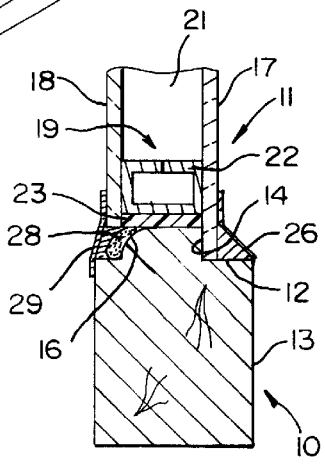
FIG. 3

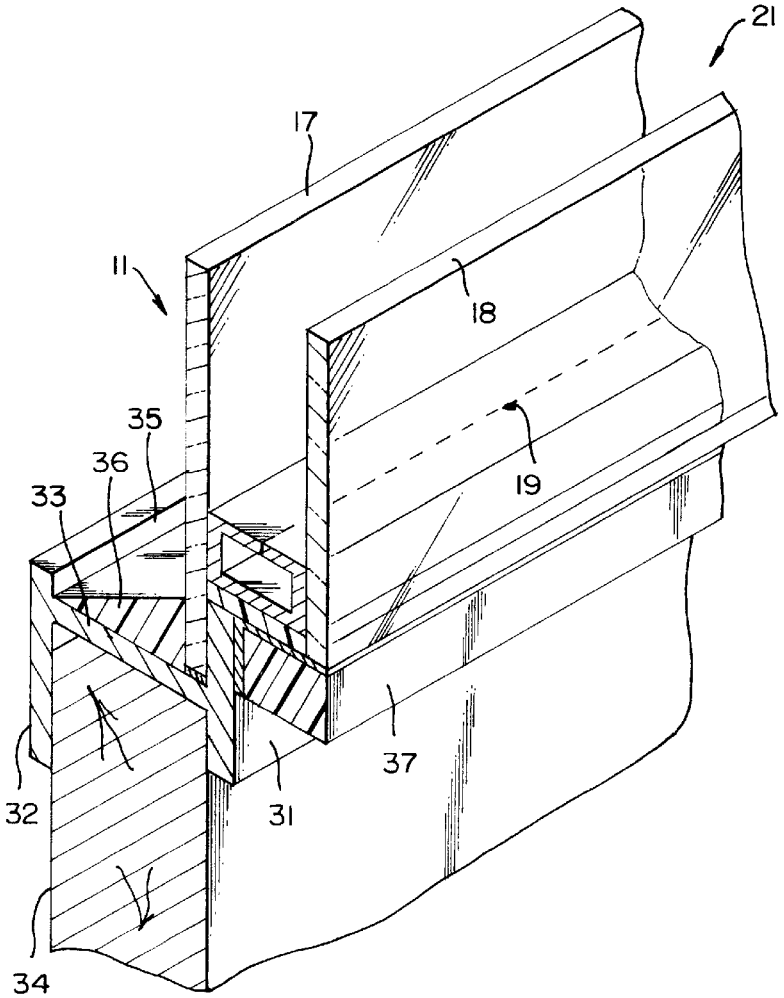
FIG. 4
FIG. 5
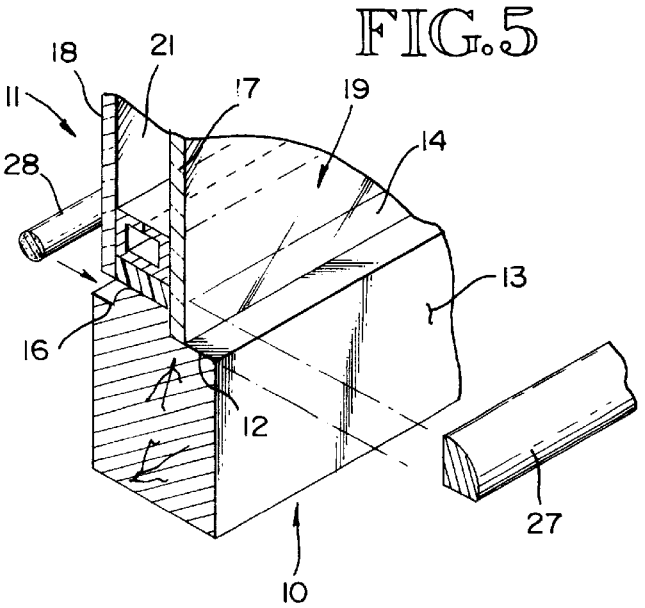
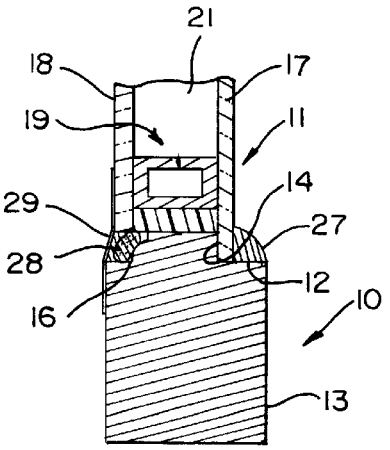
FIG. 6

PASS-BY INSULATING GLASS WINDOW UNIT AND METHOD FOR REPLACING SINGLE GLAZING

BACKGROUND OF INVENTION

1. Field of the Invention:

The present invention relates to an insulating multiple glazed window unit for replacing single glazing in window openings. More particularly, the present invention relates to a novel method of constructing and installing a replacement multiple glazed window unit in an older single glazed window. The method accomplishes the retro fitting of older single glazed window sashes without removing the original window frame and sash and without destroying the aesthetics of the original window.

2. Description of the Prior Art:

Many existing buildings are constructed using single glazed windows which were installed in a era when energy efficiency and noise reduction were minor considerations at best. With the increased emphasis on energy efficiency in recent years, double glazed windows have become the norm and single glazed windows have become a renovation problem in older buildings. Often the single glazed windows are replaced with newly manufactured double paned windows that are expensive and do not duplicate the style of the older windows, significantly altering the aesthetics of the building. Thus, there is a long felt need for a reliable method to improve the energy efficiency and noise characteristics of older windows inexpensively and in a manner that preserves the aesthetics of the original window.

The prior art includes examples of various structures and methods which are intended to bring the benefits of insulating glass to existing single glazed window openings. The following listed patents are illustrative of these attempts:

| Patent No. | Patentee |
|---|---|
| 2,177,001 | Owen |
| 3,299,591 | Woelk |
| 3,971,178 | Mazzoni et al |
| 4,074,480 | Burton |
| 4,194,331 | Gingle et al |
| 4,357,187 | Stanley et al |
| 4,494,342 | Decker |
| 4,499,703 | Rundo |
| 4,719,728 | Erikkson et al |

All of the above patents disclose methods which utilize the technique of adhering an additional glazing spaced a distance from the existing glazing without removing the window pane from the frame and the construction site. Some require removal of the window sash but, all require mechanical aptitude and skill for the on-site assembly of the additional glazing. All of the patents listed lack methods to insure the interior cleanliness of the glazing or the integrity of the glazing seal and all retain the existing glazing in place. The glazing often lacks the characteristics of modern glass which include improved strength, clarity and modern energy coatings. Additionally, the construction methods taught by these prior art patents have not been demonstrated to satisfy energy code requirements.

SUMMARY OF THE INVENTION

The present invention provides an insulating glass window unit that can be installed in a window sash and other window openings configured for single glazing, thus saving the cost of replacing the sash while retaining the aesthetic and insulating value of the wood sash. The older single glazing is removed from the window sash and the retrofit or replacement window glass unit of the present invention is installed without altering the configuration of the sash. The replacement insulating glass window unit may be manufactured off-site utilizing strict manufacturing standards for insulating windows such as quality control of strength and clarity as well as sealing methods and the use of insulating gasses and desiccants between multiple glazing. The retrofit window unit may thus be prepared and installed with the same high standards of quality and warranty provided by a commercially assembled unit. Installation of the premanufactured window unit into the existing window sash may be, however, accomplished by any do-it-yourself type building owner. According to the present invention, a multiple glazing window unit is provided which has an exterior pane which is dimensionally larger in surface area than the remaining or interior pane(s) and is of such a size as to be snugly received in the sash in place of the original single glazing. The interior pane or panes which are separated from the larger exterior pane are sized so as to pass through the sash opening and over the reveal. The larger exterior pane is then held in the sash in the normal manner by either a stop or metal glazing points with a putty string. A caulking may be used to finish off or fill the interior of the window between the window unit and the reveal of the sash. With this method, preassembling the insulating glass unit enables the manufacture of a retrofit glazing unit having all of the qualities and glazing choices available for new windows. With this method, it is necessary only to remove the existing single glazing and to mount the new unit's exterior presized pane in the single glazing opening in the sash without removing the sash. The remaining thickness of the insulating unit is sized so as to pass through the opening provided in the original sash. The larger exterior pane is then secured by glazing compound or any other standard form of retention and the interior periphery of the insulated unit is caulked to give a finished appearance.

BRIEF DESCRIPTION OF THE DRAWINGS

FIG. 1 is an exploded isometric view of a sash with the single glazing removed and the insulated glass window unit of the present invention positioned for mounting;

FIG. 2 is a perspective view showing a cross section of a sash with the glazing unit in place in the process of being caulked and sealed about the inner periphery of the unit;

FIG. 3 is a cross sectional view of the insulating glass unit and sash with the caulking and glazing compound in place;

FIG. 4 is a partially sectioned isometric view of an insulating glass window installed in a metal window sash;

FIGS. 5 and 6 are cross sectional views showing the use of a stop for holding the window unit in place.

DESCRIPTION OF THE PREFERRED EMBODIMENTS

Figure 7:
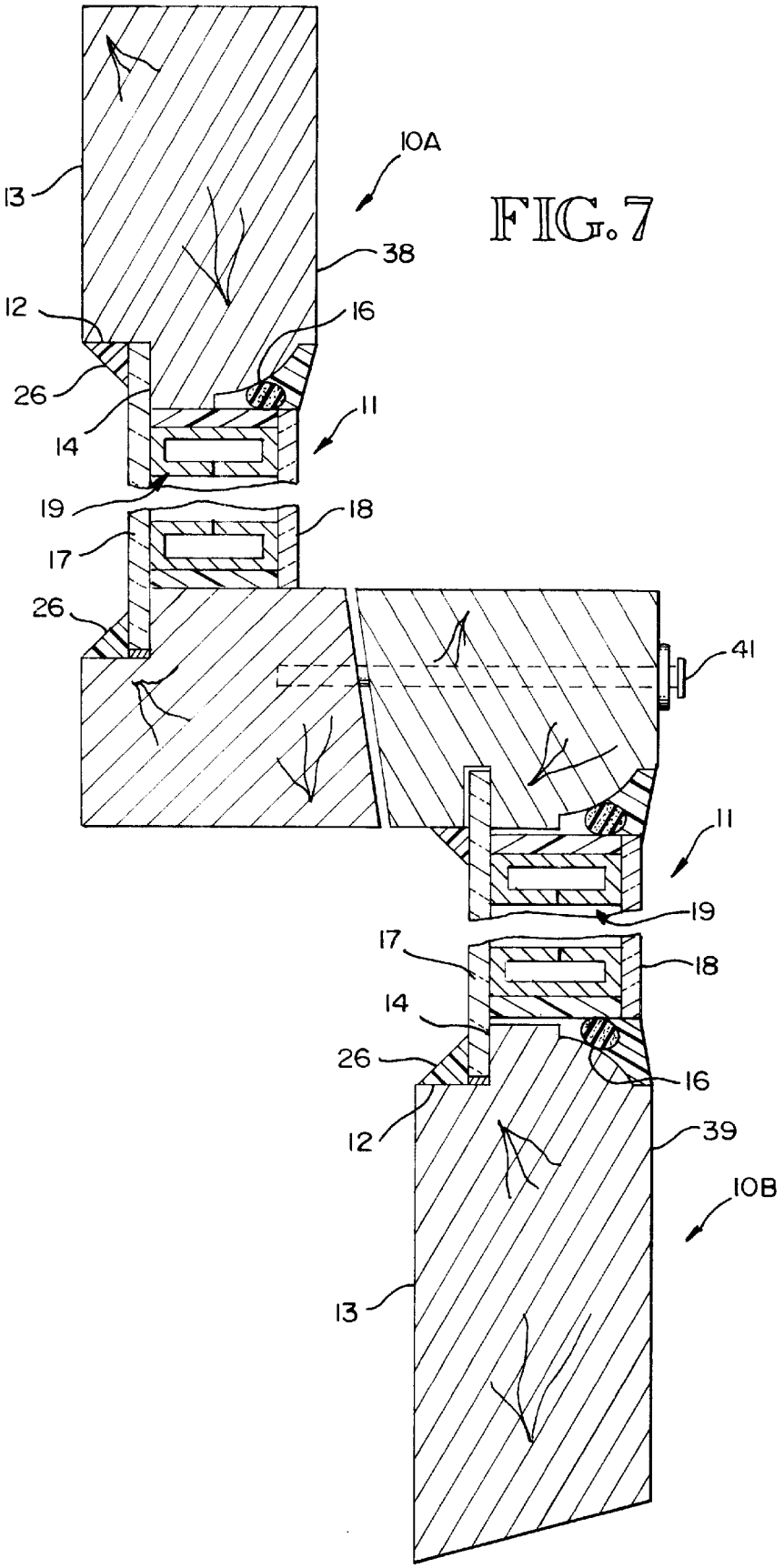
FIG. 7 is a cross sectional view of a double hung wood frame window fitted with the pass-by insulating glass window unit of the present invention.

FIG. 1 illustrates a configuration of a well known single glazed window sash indicated generally at 10 and an insulating double glazed pass-by window unit 11, according to the present invention. The sash 10 is illustrated as being a wooden rectangular frame but it will be understood that the exact configuration and dimensions of the sash will vary widely and that the wooden sash depicted is by way of example only. Typically the sash includes a glazing rabbet 12 which extends around the complete periphery of the window opening in the sash. The rabbet 12 is formed in the outer face or surface 13 of the sash and provides a seating for positioning the single glazed pane in the sash with the inner face 14 of the rabbet providing a stop against which the inner periphery of the glass pane rests. In a typical residential installation, the rabbet 12 extends inwardly a distance of approximately 7/16 of an inch from the face of the sash and the vertical height of the face 14 would be approximately 3/8 inch. It will be understood, of course, that these dimensions are not fixed and may vary according to the manufacturer. As shown in FIGS. 2, 3 and 5–7, the inside edge of the sash 10, 10A, 10B is usually milled to form a reveal 16 which may vary widely in contour but is designed to break the inside edge of the sash for aesthetic purposes.

It is noted that the sash 10 is illustrated in FIG. 1 with the original single pane or glazing removed. Normally the pane is held in the rabbet 12 by means of glazing points and a glazing compound or putty string which extends around the outer edge of the rabbet to hold the window and pane in place. The removal of the original window pane is well within the skill of the do-it-yourself homeowner and requires no special tools other than a common putty knife or screwdriver. Once the single glazing has been removed, and the rabbet 12 cleaned of all debris, the sash is ready for installation of the insulating glass window unit of the present invention.

As seen most clearly in FIGS. 1–3, the insulating glass window unit 11 is shown as a double glazed unit. The double glazed or double pane assembly is by far the most commonly used design for residential use. The two panes, outer pane 17 and inner pane 18, may be spaced a distance of 3/4 of an inch or less with a 3/4 inch spacing resulting in a unit which has a nominal overall width of one inch. The manufacturing methods and materials for producing the sealed multiple pane insulating unit are highly developed and form no part of the present invention per se. The most widely used configuration of sealed unit will include an interior sealing assembly indicated generally at 19 which extends completely around the periphery of the pane 18, defining an insulation space 21 which is completely enclosed and hermetically sealed. Referring to FIGS. 2 and 3, the interior sealing assembly 19 will normally include a metallic spacer element 22, usually in the form of a metal channel, and a sealant body 23 located about the outside edge of the channel. The channel side walls are sealed to the window pane surface with an extremely strong adhesive bond. The insulation space 21 between the panes may be subject to vacuum pressure or filled with an inert gas and in some instances the spacer element 22 may be provided with a desiccant system for controlling any moisture that might be present. As aforementioned, the art of manufacturing the insulating glass unit and the many variations possible is well developed as will be appreciated by those familiar with the art. According to the teachings of the present invention, the window unit is manufactured such that the surface dimensions of the outside pane 17 will be greater than the dimensions of the interior pane 18 and will be nominally the same as the original single glazing so as to be easily received in the rabbet 12 during installation. As used throughout this specification, the term "plane dimensions" refers to the surface dimensions of the glazing or pane. The interior pane 18 will be dimensioned so as to easily pass by the opening in the sash and extend over the reveal 16 as shown in FIGS. 2 and 3. The terminology "pass-by insulating glass window" is used to describe the structural configuration of the body of the window unit that enables the interior portion of it to pass through the sash opening.

Once the window unit has been placed in position with the outer pane 17 seated in the rabbet 12 and the remaining body of the unit passing by the reveal on the inner side of the sash, the unit is ready for securement to the sash. As indicated in FIGS. 2 and 3, the pane 17 may be secured in the rabbet 12 by conventional means such as glazing points (not shown) and a putty strip 26. In the alternative, as shown in FIGS. 5 and 6, an exterior stop 27 in the form a quarter round strip may be used. In order to finish off and seal the inner face of the sash, a filler such as the flexible foam backing rod 28 may be located between the outer edge of the pane 18 and the sash. A caulking material 29 such as latex adhesive caulk may be used to cover the filler 28 and span the area between the interior pane 18 and the extreme inner edge of the sash. The choice of caulking and filler material as well as their installation is well within the skill of the average do-it-yourself handyman. The filled and caulked interior periphery of the window unit and sash may then be painted with a layer of paint preferably extending onto the surface of the pane 18 to hide the edge of the spacer 22 as shown in FIG. 3. Application of the paint layer is also deemed to be well within the skill of the average person.

FIG. 4 illustrates an embodiment of the invention as applied to metal window sashes. As seen in FIG. 4, the metal sash usually comprises an extruded cross section made from aluminum or other soft metal which includes an inside sash or a rail 31 and an outside flange 32 with a connecting web 33 which forms a channel for attachment to a building or other wall 34. A channel 35 is originally designed to receive a single glazing or other window structure. Once the single glazing is removed, the multiple glazed insulating window unit 11 is set in place with the periphery of the outside glazing 17 bearing against the inside rail or sash 31 and the interior glazing 18, along with the sealing assembly 19, extending inwardly over the sash 31. Standard installation techniques may be employed on the exterior glazing 17 such as the putty or caulking strip 36. A covering trim 37 of wood, plastic or other material is adhered to both the metal window sash 31 and the exposed outer edges of the sealing assembly 19 and inner pane 18. Further trimming or finish painting may be done as desired. Although the structural details of the metal window sash may vary according to the manufacturer, it is stressed that the pass-by insulating glass window unit and its method of replacement may be carried out according to the present invention.

The invention is shown in FIG. 7 installed in a double hung wood window having upper and lower window sashes 10A and 10B respectively. As illustrated, the predetermined thickness of the sealing assembly 19 is chosen so that the interior glazing 18 is nearly flush with the plane of the interior surface of the wood window sashes 38 and 39 respectively. This positioning of the interior glazing 18 assures that the two movable sashes will pass each other during opening and closing without interference. The pass-by insulating glass window unit 11 in the upper sash 10A occupies the space normally used for mounting of a conventional sash lock. A locking pin, such as used on patio doors and the like, may be substituted for the conventional sash lock. With the sashes in closed position as shown in FIG. 7, a locking pin 41 is installed. In this regard, the locking pin 41 may be installed in either the top right or top left corner of the lower sash. Additional holes in the upper sash side rail will allow varying lock open positions of these two sashes. The sash weights that counterbalance the movable sash will require additional weight to counter the increased weight of glass of a pass-by insulating glass window unit. There are many publications which explain how to access the sash weights for the benefit of do-it-yourself homeowners.

From the foregoing, it will be apparent to those of ordinary skill in the art that the present invention provides an improved insulating window glass unit and a novel method wherein the premanufactured pass-by insulating glass window unit is installed to retrofit a single glazed window. It is to be understood that the foregoing description and accompanying drawings have been given by way of illustration and example. It is also to be understood that changes in form of the several parts, substitution of equivalent elements and arrangement of parts which will be readily apparent to one skilled in the art are contemplated as within the scope of the present invention, which is limited only by the claims which follow.

What is claimed:

1. A pass-by multiple glazed window unit for use with a sash having a central opening with an exterior glazing seat extending thereabout for receiving a single glazing comprising;

an interior glazing dimensioned for passing through said opening, an exterior glazing having plane dimensions greater than said interior glazing and adapted to be received in said glazing seat upon removal of said single glazing, and a sealing assembly bonded to said interior and exterior glazing forming an hermetically sealed insulating space therebetween prior to placement in said opening.

2. A pass-by multiple glazed window unit for retrofitting a single glazed window having a sash adapted for mounting in a window frame and including a central opening, said sash further including an exterior glazing seat on the periphery of said central opening for receiving said single glazing, said pass-by multiple glazed window unit comprising;

an interior glazing having predetermined plane dimensions in close conformance with said central opening while permitting passage therethrough, an exterior glazing having plane dimensions greater than said interior glazing and in close conformance with the dimensions of said glazing seat to permit seating therein upon removal of said single glazing, and a sealing assembly extending about the peripheral edge of said interior glazing, said sealing assembly being bonded to said exterior and interior glazings forming an hermetically sealed insulating space therebetween prior to placement of said pass-by window unit in said central opening, whereby, enabling state-of-the-art manufacturing techniques for said pass-by multiple glazed insulating window unit off-site prior to being secured in said single glazed window sash after removal of said single glazing and without requiring removal of said sash.

3. The pass-by multiple glazed window unit according to claim 2 wherein;

said exterior glazing is rectangular and is positioned relative to said interior glazing such that all four edges thereof extend equidistant from the outer edges of said interior glazing and sealing assembly.

4. The pass-by multiple glazed window unit of claim 2 wherein;

said exterior and interior glazings are spaced a predetermined distance such that the exposed surface of said interior glazing is in substantial alignment with the interior face of said sash.

5. The pass-by multiple glazed window unit of claim 2 wherein;

said sash comprises a wood sash, said glazing seat comprising a rabbet extending about the peripheral edge of said opening, and caulking filler means located between the edge of the inner face of said sash and the peripheral edge of said interior glazing.

6. A method of retrofitting a single glazed window with a multiple glazed insulating window unit, said single glazed window being seated in an exterior glazing seat on the outside surface of a window mounting about a central opening therein, comprising the steps of;

fabricating a multiple glazed insulating window unit having an interior glazing dimensioned to pass-by said central opening and an exterior glazing of greater dimensions adapted to be received in said external glazing seat with a sealing assembly bonded thereto creating an hermetically sealed insulating space between said glazings, removing said single glazing from said window mounting, and then mounting said multiple glazed unit in said window mounting by passing said interior glazing and sealing assembly through said central opening and seating said exterior glazing in said exterior glazing seat.

* * * * *